US007481702B2

(12) United States Patent
Bell et al.

(10) Patent No.: US 7,481,702 B2
(45) Date of Patent: Jan. 27, 2009

(54) USING COIN DIMENSIONS AND COIN STORAGE BIN VOLUME TO ESTIMATE WHEN BIN IS FULL

(75) Inventors: Kevin H. Bell, Wake Forest, NC (US); Richard J. Kairis, Jr., Raleigh, NC (US); Susan E. Wince, Oxford, NC (US)

(73) Assignee: International Business Machines Corporation, Armonk, NY (US)

( * ) Notice: Subject to any disclaimer, the term of this patent is extended or adjusted under 35 U.S.C. 154(b) by 67 days.

(21) Appl. No.: 11/558,664

(22) Filed: Nov. 10, 2006

(65) Prior Publication Data

US 2008/0110722 A1 May 15, 2008

(51) Int. Cl.
*G07D 9/00* (2006.01)

(52) U.S. Cl. ..... 453/16; 702/156

(58) Field of Classification Search ..... 453/16, 453/58, 63; 73/163

See application file for complete search history.

(56) References Cited

U.S. PATENT DOCUMENTS 3,858,733 A * 1/1975 Morioka et al. ..... 414/291
4,124,775 A 11/1978 Zarouni
5,607,350 A 3/1997 Levasseur et al.
5,722,834 A * 3/1998 Rivera et al. ..... 434/128
5,737,401 A * 4/1998 Grantland et al. ..... 379/147
5,742,656 A * 4/1998 Mikulak et al. ..... 377/7

FOREIGN PATENT DOCUMENTS

DE 4213920 A1 4/1992
EP 0477722 A2 9/1991

OTHER PUBLICATIONS

JP04-340694. Publication Date: Nov. 27, 1992 "Coin Processor". (Abstract Only).
JP04-184588. Publication Date: Jul. 01, 1992 "Coin Processor". (Abstract Only).

* cited by examiner

*Primary Examiner*—Patrick Mackey
*Assistant Examiner*—Mark Beauchaine
(74) *Attorney, Agent, or Firm*—Cantor Colburn LLP; Jason Piche

(57) ABSTRACT

As disclosed herein, a method for determining when a coin storage bin having a bottom and sides is filled to a predetermined percentage of the volume of the coin storage bin comprises: determining a coin volume for a coin entering the coin storage bin, adding the coin volumes for each coin entering the coin storage bin to provide a running total volume of all coins entering the coin storage bin, comparing the running total volume of all coins entering the coin storage bin with the volume of the coin storage bin, and determining when the running total volume of all coins entering the coin storage bin is greater than or equal to the predetermined percentage of the volume of the coin storage bin. The volume for a coin can be determined from information provided by a coin acceptor, where the information is thickness, diameter, weight, or a combination comprising at least one of these.

9 Claims, 1 Drawing Sheet

USING COIN DIMENSIONS AND COIN STORAGE BIN VOLUME TO ESTIMATE WHEN BIN IS FULL

TRADEMARKS

IBM® is a registered trademark of International Business Machines Corporation, Armonk, N.Y., U.S.A. Other names used herein may be registered trademarks, trademarks or product names of International Business Machines Corporation or other companies.

BACKGROUND OF THE INVENTION

1. Field of the Invention

A method of estimating when a coin storage bin is full is disclosed. Specifically, a method of using coin dimensions to estimate when a coin storage bin is filled to a predetermined percentage of the volume of the coin storage bin is disclosed.

2. Description of Background

A typical Coin Acceptor has a bin for collecting coins but no means of detecting or reporting that the bin is overflowing or about to overflow. An overflowing coin storage bin can result in a jam of the Coin Acceptor itself or it could interfere with the operation of other devices in the system either of which will affect system availability. It is therefore desirable to be able to determine how fall a coin bin is to prevent overflow and jamming of the system.

SUMMARY OF THE INVENTION

The shortcomings of the prior art are overcome and additional advantages are provided through the provision of a method for determining when a coin storage bin having a bottom and sides is filled to a predetermined percentage of the volume of the coin storage bin, comprising: determining a coin volume for a coin entering the coin storage bin from information provided by Coin Acceptor, adding the coin volumes for each coin entering the coin storage bin to provide a running total volume of all coins entering the coin storage bin, comparing the running total volume of all coins entering the coin storage bin with the volume of the coin storage bin, and determining when the running total volume of all coins entering the coin storage bin is greater than or equal to the predetermined percentage of the volume of the coin storage bin.

In a further embodiment, information provided by a coin acceptor is thickness, diameter, weight, or a combination comprising at least one of these.

Additional features and advantages are realized through the techniques of the present invention. Other embodiments and aspects of the invention are described in detail herein and are considered a part of the claimed invention. For a better understanding of the invention with advantages and features, refer to the description and to the drawings.

TECHNICAL EFFECTS

As a result of the summarized invention, technically we have achieved a solution which provides an accurate estimation of the volume of coins collected in a coin storage bin from boundary dimensions (coin bin dimensions and angles, and coin dimensions including diameter, thickness, weight, or the like). The point at which the coin bin is full i.e., at which the volume of the coins has reached a predetermined percentage of the volume of the coin storage bin (also referred to as the bin's volume), indicating the bin is full or "near full," can be determined by software, and a signal can be sent to the vending machine or any type of system including a coin acceptor, or to a service provider indicating the coin bin is filled to a predetermined volume, e.g., is full, near full, or approaching capacity.

BRIEF DESCRIPTION OF THE DRAWINGS

The subject matter regarded as the invention is particularly pointed out and distinctly claimed in the claims at the conclusion of the specification. The foregoing and other objects, features, and advantages of the invention are apparent from the following detailed description taken in conjunction with the accompanying drawings in which:

The detailed description explains the preferred embodiments of the invention, together with advantages and features, by way of example with reference to the drawings.

DETAILED DESCRIPTION OF THE INVENTION

Surprisingly, it has been found that providing information from a Coin Acceptor about coins entering a coin storage bin can be used to accurately estimate when a coin storage bin is filled to a predetermined volume and/or height, as determined from appropriate volume calculations for the coin. Using the information, the Coin Acceptor reports for an accepted coin and the dimensions (e.g., volume, or a combination of volume, height, or other interior dimensions) of the coin storage bin, and this information is then used to determine when the volume of coins in the bin has reached a predetermined percentage of the bin's capacity. The predetermined percentage is a value of less than or equal to 100% of the bin's volume. In an exemplary embodiment, the information can be used to determine when the bin is fall and/or is about to overflow.

For each accepted coin, a Coin Acceptor reports information that allows software to determine the type of coin that was accepted. Once the type of coin is known, dimensions for that type of coin are retrieved. The retrieved dimensions could be the diameter and thickness of the coin from which the coin's volume can be calculated, or the retrieved dimension could be the coin's volume. Each coin's volume is added to a running total of the volume of all coins accepted. This total is compared to the volume of the coin storage bin. When the volume of accepted coins becomes greater than a specified percentage of the coin storage bin's volume, a notification signal is generated indicating that the bin has filled to a predetermined level. For example, the bin may be full when the predetermined percentage of the bin's volume reaches 100% and that the bin is about to overflow, or the bin may be "near full" when the volume of coins is a value less than 100% of the predetermined percentage of the bin's volume. Such a value for "near full" is not limited and can be arrived at by a practitioner based upon an appropriate and desired value for the circumstances in which the coin storage bin fills with coins, and can be predicated on such parameters as, for example, the rate at which the coin storage bin is filling, the anticipated usage of the coin acceptor based on the hour of the day, day of the week, or holiday; the presence of the coin acceptor at scheduled or non-scheduled events having regular, irregular, or semi-regular usage, or the like. When the coin storage bin is emptied, the total volume of accepted coins must be reset.

Figure 1:
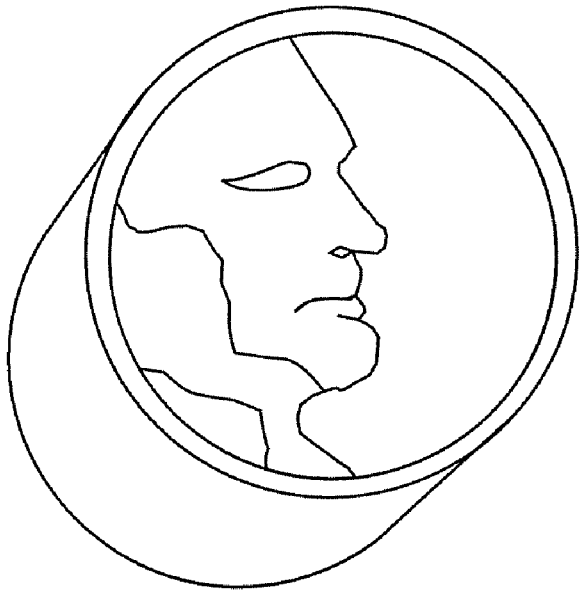
FIG. 1 illustrates an example of a coin having a volume that is calculated base on the volume of a cylinder corresponding to the dimensions of the coin.

Depending on the type of coin storage bin, different volume calculations should be used. Turning now to the drawings in greater detail, in an embodiment, in FIG. 1, where the coins are stored in cylinders by denomination, cylindrical volumes should be used. For example, a U.S. nickel has a diameter of 21.21 mm (radius of 10.605 mm) and a height of 1.95 mm, and therefore its cylindrical volume can be calculated using the equation for volume of a cylinder as shown in Equation 1:

$$V_{cyl}=\pi\cdot r^2\cdot h \qquad \text{(Equation 1)}$$

where $V_{cyl}$ is the cylindrical volume of the coin, r is the coin's radius, and h is the height of the cylinder. For example, the cylindrical volume of a U.S. nickel is approximately 687 cubic mm.

Figure 2:
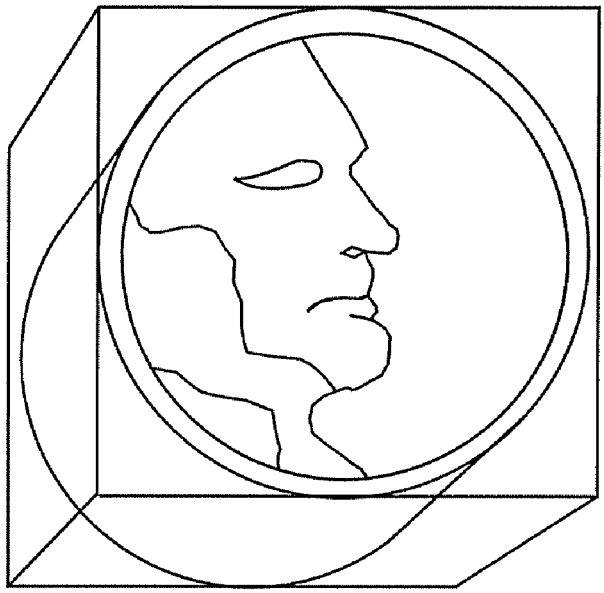
FIG. 2 illustrates an example of a coin having a volume that is based on the smallest rectangular prism the coin will fit into.

In another embodiment, the coins are not sorted, but enter a common coin storage bin. In an exemplary embodiment, for IBM® Self Checkout Systems, the coin storage bin is rectangular. The coins are dropped in the coin storage bin and pile up to form a coin pile; there is no sorting or stacking. To compensate for the empty space created when various size coins pile up, some of the empty space around each coin is used in the calculation of a coin's volume. Thus, as seen in FIG. 2, the volume can be calculated based on the smallest rectangular prism the coin will fit into using the calculation for volume of a rectangular prism with equal sided base, as shown in Equation 2:

$$V_{tet}=d^2\cdot h \qquad \text{(Equation 2)}$$

wherein d is the coin diameter (squared), and h is the coin height. For example, for the U.S. nickel, this volume is approximately 877 cubic mm.

For other implementations, where additional refinement to the estimation of the volume of coins in the coin storage bin is desired, the slope angle and density of the coin pile as it forms can be calculated from the average coin volumes, friction coefficient of the coin surfaces, surface area of the bottom of the bin, angles of the sides of the coin storage bin to the bottom of the coin storage bin and to each other, and the like, or a combination comprising at least one of the foregoing. These properties are similarly used to calculate slope angle and density of talus (i.e., a pile of rocks that accumulates at the base of a cliff, chute, or slope [from Geology]) and could be applied here as well, to provide an additional dimensional measurement to more accurately determine the height and volume of coins in the coin storage bin, and thereby provide greater accuracy in determining when the coin storage bin is filled to a predetermined percentage of the bin's volume. In an embodiment, the coin storage bin is determined to be filled to the predetermined percentage of the volume of the coin storage bin, when a height for the coin pile as determined using the above-described parameters is greater than or equal to a predetermined height of the coin storage bin.

Thus, in an embodiment, the method for determining when a coin storage bin is filled to a predetermined percentage of the volume of the coin storage bin comprises determining a coin volume for a coin entering the coin storage bin from information provided by a coin acceptor, adding the coin volumes for each coin entering the coin storage bin to provide a running total volume of all coins entering the coin storage bin, comparing the running total volume of all coins entering the coin storage bin with the volume of the coin storage bin, and determining when the running total volume of all coins entering the coin storage bin is greater than or equal to the predetermined percentage of the volume of the coin storage bin.

The capabilities of the present invention can be implemented in software, firmware, hardware or some combination thereof.

In an embodiment, the method accepts information from a Coin Acceptor having appropriate sensing capability. For example, the Coin Acceptor may, in an embodiment, use light sensors, infrared detectors, photocells, mechanical sensors, surface reflectance sensors, weight sensors, other size and/or shape recognition sensors, a combination comprising at least one of these methods, and the like. The Coin Acceptor can provide information including coin diameter, coin thickness, coin weight, and the like.

As one example, one or more aspects of the present invention can be included in an article of manufacture (e.g., one or more computer program products) having, for instance, computer usable media for. The media has embodied therein, for instance, computer readable program code means for providing and facilitating the capabilities of the present invention. In an embodiment, computer executable code is software which performs functions including calculating the volume based on the coin dimensional input, comparing the cumulative volume of the coins with the volume of the coin storage bin, providing a signal that the coin bin is filled to a predetermined percentage of the bin's volume, or a combination comprising at least one of these functions. The article of manufacture can be included as a part of a computer system or sold separately.

Additionally, at least one program storage device readable by a machine, tangibly embodying at least one program of instructions executable by the machine to perform the functions including the determinations of coin dimension, calculation and comparison of coin volume, additional calculation for refining estimate for how full the coin storage bin is, and the notification can be provided.

The singular forms "a," "an," and "the" include plural referents unless the context clearly dictates otherwise. All references are incorporated herein by reference. The terms "first," "second," and the like herein do not denote any order, quantity, or importance, but rather are used to distinguish one element from another. There may be many variations to these steps, operations, and functions described herein without departing from the spirit of the invention. For instance, the steps may be performed in a differing order, or steps may be added, deleted or modified. All of these variations are considered a part of the claimed invention.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

What is claimed is:

1. A method for determining when a coin storage bin is filled to a predetermined percentage of the volume of the coin storage bin, comprising:

determining a coin volume for an unsorted cylindrical coin entering the coin storage bin, along with other unsorted cylindrical coins, from information provided by a coin acceptor as being equal to a volume of a smallest rectangular prism into which the cylindrical coin will fit along with empty space in corners of the prism which at least partly accounts for a volume of spaces between the unsorted coins in the coin storage bin, adding the coin volumes for each of the unsorted cylindrical coins entering the coin storage bin to thereby generate an estimate of a height of a coin pile formed of each of the unsorted cylindrical coins in the coin storage bin, comparing the estimate of the height of the coin pile with a height of the coin storage bin, and determining when the estimate of the height of the coin pile is greater than or equal to the height of the coin storage bin.

2. The method of claim 1, wherein the information provided by the coin acceptor is thickness, diameter, weight, or a combination comprising at least one of these.

3. The method of claim 1, wherein the unsorted coins entering the coin storage bin form the coin pile.

4. The method of claim 1, wherein the height of the coin pile is determined from a slope angle and a density of the unsorted coins therein.

5. The method of claim 4, wherein the coin storage bin has a bottom and sides, and wherein the slope angle and the density of the coin pile is determined from an average of the coin volumes, a friction coefficient of the coin's surfaces, a surface area of the bottom of the coin storage bin, an angle of the sides of the coin storage bin relative to the bottom of the coin storage bin and to each other, or a combination comprising one or more of these.

6. The method of claim 1, further comprising transmitting a signal indicating the coin storage bin is filled when the estimate of the height of the coin pile is greater than or equal to the height of the coin storage bin.

7. The method of claim 6, further comprising resetting the estimate of the height of the coin pile after an emptying of the coin storage bin.

8. A method for determining when a coin storage bin is filled to a predetermined percentage of the volume of the coin storage bin, comprising:

providing information to software from a coin acceptor wherein the information provided by the coin acceptor is thickness, diameter, weight, or a combination comprising at least one of these, determining a least rectangular coin volume for a coin entering the coin storage bin from the information provided, adding the coin volumes for each coin entering the coin storage bin to provide a running total volume of all coins entering the coin storage bin, comparing the running total volume of all coins entering the coin storage bin with the volume of the coin storage bin, determining when the running total volume of all coins entering the coin storage bin is greater than or equal to the predetermined volume of the coin storage bin, transmitting a signal indicating the coin storage bin is filled to a predetermined percentage of the volume of the coin storage bin when the running total volume is greater than or equal to the predetermined percentage of the volume of the coin storage bin, and resetting the running total volume of the coin storage bin after emptying the coin storage bin;

wherein the volume for the coin is the least rectangular prism volume into which the coin will fit along with empty space in corners of the prism which at least partly accounts for a volume of spaces between each of the coins in the coin storage bin, the coins are not sorted as they enter the coin storage bin, the coins entering the coin storage bin form a coin pile in the coin storage bin, and the coin storage bin is determined to be filled to a predetermined volume when a height for the coin pile is greater than or equal to a predetermined height for the coin storage bin.

9. The method of claim 8, further wherein the coin storage bin has a bottom and sides, and wherein the height of the coin pile is determined from a slope angle and density of coins in the coin pile upon entry of each coin into the coin storage bin, and wherein the slope angle and density of the coin pile is determined from an average of the coin volumes, a friction coefficient of a coin's surfaces, a surface area of the bottom of the coin storage bin, an angles of the sides of the coin storage bin relative to the bottom of the coin storage bin and to each other, or a combination comprising one or more of these.

* * * * *